US008402700B2

(12) United States Patent
Hall et al.

(10) Patent No.: US 8,402,700 B2
(45) Date of Patent: Mar. 26, 2013

(54) WALL ASSEMBLY COMPRISING PANELS CONFIGURED TO RESIDE IN AN OVERHEAD STRUCTURE

(76) Inventors: David R. Hall, Provo, UT (US); Craig Garvin, Provo, UT (US); Matt Godsey, Provo, UT (US); Hyrum Lee, Provo, UT (US); Byron Garvin, Provo, UT (US); Daniel Garvin, Provo, UT (US)

( * ) Notice: Subject to any disclaimer, the term of this patent is extended or adjusted under 35 U.S.C. 154(b) by 144 days.

(21) Appl. No.: 12/979,191

(22) Filed: Dec. 27, 2010

(65) Prior Publication Data

US 2012/0159871 A1 Jun. 28, 2012

(51) Int. Cl.
*E04B 1/346* (2006.01)

(52) U.S. Cl. ..... 52/67; 52/238.1

(58) Field of Classification Search ..... 52/67, 64, 52/71, 238.1, 29; 49/360; 312/247
See application file for complete search history.

(56) References Cited

U.S. PATENT DOCUMENTS

| | | | | |
|---|---|---|---|---|
| 2,968,048 | A | 1/1961 | Roberge | |
| 3,832,810 | A * | 9/1974 | Johnston | 52/67 |
| 4,853,989 | A | 8/1989 | Garcia | |
| 5,461,735 | A | 10/1995 | Danton | |
| 5,943,714 | A | 8/1999 | Gignam | |
| 6,336,692 | B1 | 1/2002 | Snyder | |
| 6,691,463 | B1 * | 2/2004 | Richmond | 49/360 |
| 6,698,040 | B1 | 3/2004 | Acevedo | |
| 2006/0101738 | A1 * | 5/2006 | Lethers et al. | 52/204.51 |

* cited by examiner

*Primary Examiner* — Jeanette E Chapman
*Assistant Examiner* — Daniel Kenny
(74) *Attorney, Agent, or Firm* — Philip W. Townsend, III

(57) ABSTRACT

In one aspect of the present invention, a wall assembly may be used to divide the area of a particular living space. The wall assembly may comprise a first and second panel. The first panel may reside within an internal cavity of the second panel. The first panel may also extend beyond the second panel such that both panels may collectively form a wall. A cable may connect the wall assembly to an overhead structure such that it may pull the wall into a storage space of the overhead structure.

19 Claims, 13 Drawing Sheets

WALL ASSEMBLY COMPRISING PANELS CONFIGURED TO RESIDE IN AN OVERHEAD STRUCTURE

BACKGROUND OF THE INVENTION

The present invention relates to a wall assembly used to divide the area of a room. Residential and commercial buildings typically comprise permanent barriers to divide the space therein. Efforts to increase space utility are disclosed in the prior art. These include inventions such as retractable beds, couches, and other furniture items that may be stored in overhead compartments.

U.S. Pat. No. 2,968,048, which is herein incorporated by reference for all that it contains, discloses a bed platform and winch system having a sleeping platform for supporting a mattress, a ceiling support attached to the ceiling and having a winch contained therein and wires connect the winch to the sleeping platform and extending through the ceiling support, such that the sleeping platform may be raised out of the way when not needed for sleeping and lowered when needed for sleeping.

U.S. Pat. No. 5,943,714, which is herein incorporated by reference for all that it contains, discloses a vertically displaceable bed platform suspended form a ceiling engagement region, and four pulley members each disposing an equal vertical distance from the engagement regions such that two correspond with the forward regions and two with the reward regions. Four cables are each connected to one of the engagement regions, with a first pair of cables connected to the forward region about the corresponding forward pulleys, and a second pair of cables connected to the rearward regions about the rearward pulleys to join with the first pair of cables. The joined pairs of cables are attached to a counterweight, such that downward motion of the counterweight causes an equal reduction in the four vertical distances and retraction of the platform in the direction of the veiling to a fully retracted position. Upward motion of the counterweight lowers the platform to a fully vertically extended position by extending the cable s an equal distance. A pair of transverse mounted telescoping brace members traverse the distance from a respective forward region of engagement to the corresponding rearward pulleys and a pair of crossed telescoping brace member are attached to the reward portion of the platform to the corresponding rearward pulley members.

U.S. Pat. No. 5,461,735, which is herein incorporated by reference for all that it contains, discloses a bed or cot structure which can be retracted into a ceiling. The bed structure is designed to fit within a recess, formed in a ceiling, which serves as a receptacle of the structure. An elongate pivoting support is rotationally coupled at one end with the recess such that it may be rotated downwardly form the recess, from a retracted to an operation position. The bed or cot is rotationally coupled to the other end of the pivoting support such that it may be rotated into a horizontal and operational orientation upon rotation of the pivoting support into its operational position. The structure is further designed to include both a controlling device which provides for easier manual control of the deployment and retraction of the bed between the recess and its operation position, and locking device for locking the bend into a desired position.

U.S. Pat. No. 4,853,989, which is herein incorporated by reference for all that it contains, discloses a device to unfold and retract a bed, sofa or something similar into a structure in a false ceiling. The object of the invention is a device that unfolds and retracts a bed, or the like designed to be integrated in a system of suspended devices. This invention comprises a panel composed of ceiling elements that when closed, in horizontal position, forms a false ceiling. The panel is hinged to move between two stable positions: the horizontal, closed position; and the vertical open position. Attached to the inside face of the panel and parallel to it is a fixed frame. Slidable attached to the fixed frame is a mobile frame. Articuably mounted to the mobile frame, about an axis parallel to the panel's axis of articulation, and at a point at the end of the mobile frame farthest from the panel's axis of articulation is furniture frame.

U.S. Pat. No. 6,698,040, which is herein incorporated by reference for all that it contains, discloses a retractable bed for mounting in a ceiling of a room. The retractable bed includes a cap member for mounting on mounting rafters of a framed section in a ceiling and has a cap cavity. The cap member comprises a top wall, and a pair of cap side walls and cap end walls that are attached to and extend away from the top wall to define the cap cavity. A base member holds a bed and in a bed cavity. The base member comprises a bottom wall, and a pair of base side walls and base end walls being attached to and extending away from the bottom wall to define the bed cavity. The base member is selectively positionable in the cap cavity. A moving means selectively moves the base member between a retracted position and an extended position. A switch allows a user to actuate the moving means, thereby controlling the positioning of the bed.

U.S. Pat. No. 6,336,692, which is herein incorporated by reference for all that it contains, discloses a cabinet for mounting to a wall or ceiling with downward extendable and retractable shelving assembly is provided. The cabinet includes a housing having an open bottom. Disposed within the housing is a shelving assembly having a plurality of shelves. A novel combination of a tension gas spring and telescoping drawer glides are used for mounting the shelving assembly to the housing. When items are needed from the cabinet, the shelving is pulled down until all the shelves are exposed. When access is no longer needed, a light tap to the bottom of the shelving assembly causes the tension gas spring to smoothly retract the shelving assembly back into the housing.

BRIEF SUMMARY OF THE INVENTION

In one aspect of the present invention, a wall assembly comprises a first and second panel. The first panel is configured to enter an internal cavity within the second panel. It may also extend beyond the second panel such that both panels collectively form at least part of a wall. A cable may connect the first panel to an overhead structure and pull the first panel into a storage space therein. The cable may wind to a spool system which is attached to the upper surface of the storage area. It may run from the spool system, through the internal cavity of the second panel and attach to the top portion of the first panel. The spool system may be attached to the upper surface of the overhead structure. Its rotation may be controlled by an attached motor.

The internal cavity of the second panel may be large enough to accommodate the height of the first panel. Thus, the wall assembly may decrease in height in proportion to the amount of the first panel that is pulled into its cavity. In its substantially retracted position, the wall assembly may be stored within the storage space of the overhead structure. Likewise, the storage space may be large enough to accommodate the height of the wall assembly.

The first panel may enter the internal cavity of the second panel as it is pulled upwards by a cable and spool system. The first panel may also comprise a bottom flange, which may engage the bottom ends of the second panel. The top of the first panel may also engage the top surface of the internal cavity of the second panel. The second panel may thus become supported by the configuration of the first panel. As a result, both panels may continue upward through an opening within the overhead structure as.

The bottom flange of the first panel may ultimately engage the lower surface of the overhead structure and substantially seal the opening therein. As the flange seals the opening of the lower surface, the wall assembly may become fully retracted as it resides within the storage space of the overhead structure. The bottom flange may also support the panel as it rests on the floor surface of the living space. The flange may seal the first panel to the floor surface by using a magnetic charge or an electronic sealing mechanism.

In addition, the top of the second panel may also comprise a perpendicular overhang which may rest on the lower surface of the overhead structure. The lower surface may thus become a shelf from which the wall assembly may be suspended. The remaining portion of the second panel, however, may protrude through an opening within the lower surface and into the living space.

Moreover, the adjoining edges of each panel may be biased towards any adjoining wall or surface area. This may enable the wall assembly to more effectively seal off an area within the living space.

The adjoining edges may further comprise a planar bearing surface to facilitate their movement along any adjoining surface areas. As the panels continue alongside an adjoining wall or surface area, a rubber molding along the edge of both the first and second panel may also create a seal between the two adjoining surfaces. The edges of the wall assembly may also comprise a substance such as polytetrafluoroethylene to reduce friction between the surfaces.

In some embodiments, the internal cavity of the first panel may comprise an elastic or expandable element allowing the panel to be compressed as it is pulled into the internal cavity of the second panel. The engaging ends of the first and second panel may comprise parallel angles to facilitate the movement of the first panel into the internal cavity of the second panel. The angles of the engaging ends may be equivalent to 45 degrees where the angles of the first panel slope inward and those of the second panel slope outward.

The wall assembly may also comprise three panels such as a first, second, and third panel. A portion of the second panel may enter the internal cavity of both the first and the third panel. The second panel may also extend from within both panels such that all three panels form a wall assembly. A cable system may connect the wall assembly to an overhead structure and pull it into a storage space therein. The wall assembly may be pulled up through an opening within the lower surface of the overhead structure.

The three panel wall assembly may also comprise a first, second and third cable to support the first, second and third panel respectively. Each of the three cables may wind at three distinct portions on a spool system. Each portion of the spool system may comprise various diameters corresponding to the first, second and third cables such that each cable may lengthen or shorten at a different rate. Winding the cables at the various portions on the spool system may enable each panel to arrive within the storage space of the overhead structure at substantially the same time.

The present invention may be incorporated into both interior and exterior walls in both commercial and residential structures. Moreover, it may comprise various safety measures, including a locking mechanism which may support the panels while they remain within the storage space. The panels may also comprise materials that are sufficiently light in weight, such that a person may manually lift the wall in order to exit the structure as needed.

DETAILED DESCRIPTION OF THE INVENTION AND THE PREFERRED EMBODIMENT

Figure 1A:
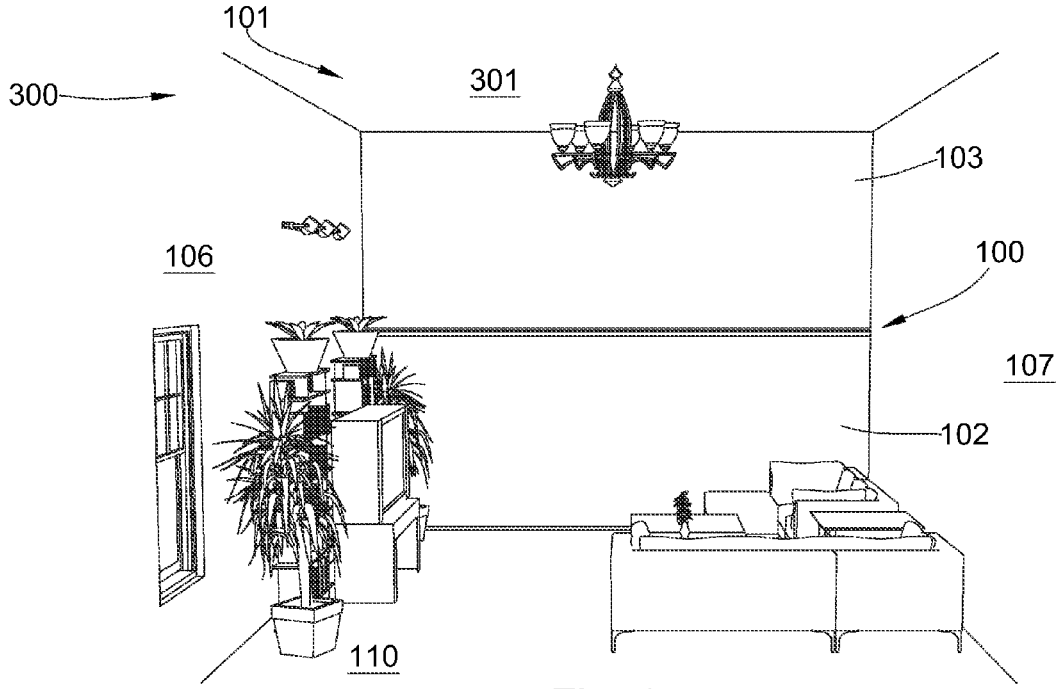
FIG. 1*a* is a perspective view of an embodiment of a structure.

In reference to the figures, FIG. 1*a* is a perspective of a structure in which the present invention is featured. It discloses a wall assembly 100 within a living space 101. In its fully extended position, the wall assembly 100 may substantially divide an area within a living space. The wall assembly 100 may comprise a first and second panel 102, 103. The panels may be vertically aligned such that the second panel 102 may extend downward from an overhead structure 300 and adjoin the first panel 103, which may extend to a floor surface 110. In this position, the wall assembly 100 may also horizontally span the distance between two permanent wall structures 106, 107.

The wall assembly 100 may also comprise a sealing member such as a rubber molding or fin attached to the longitudinal edges of the first and second panel 102, 103. The sealing member may be used to substantially seal the area where the wall assembly 100 may adjoin any additional surface such as two permanent wall structures 106, 107. Moreover, the first and second panel 102, 103 may slightly overlap where a top portion of the first panel 102 may reside within a bottom portion of the second panel 103. The overlap may result in a visible seam on the outside surface of the wall assembly 100. The bottom end of the second panel 103 may be exposed outside the top portion of the first panel 100.

Figure 1B:
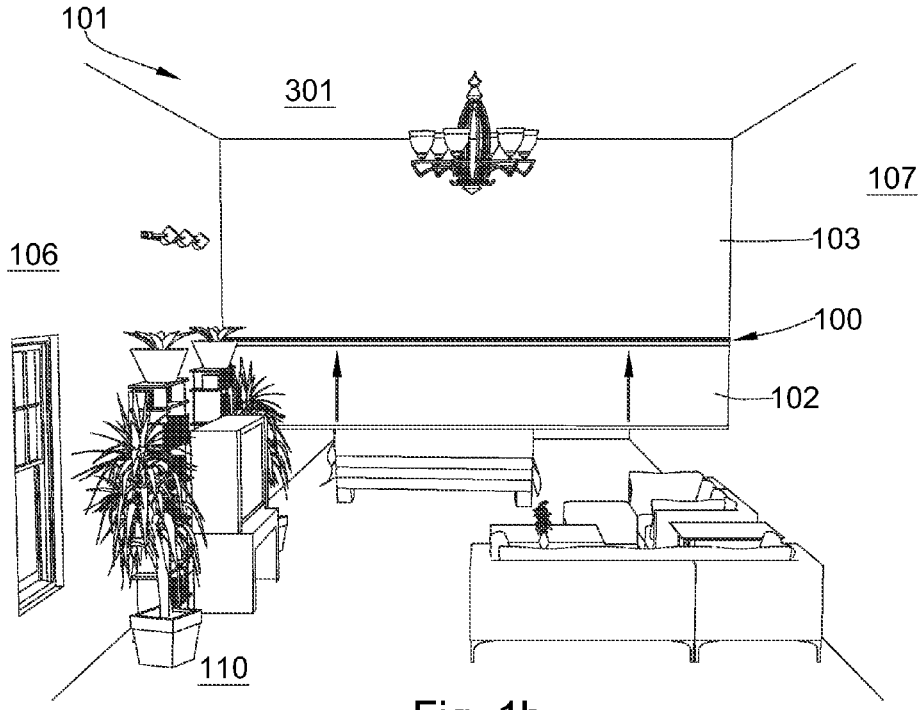
FIG. 1*b* is a perspective view of another embodiment of a structure.

FIG. 1*b* discloses the first panel 102 rising upward as it enters the second panel 103. A portion of the living space 101, previously blocked from view by the wall assembly 100, may become visible as a result. The view of the second panel 103, however, remains unchanged while the first panel 102 continues upward within the second panel 103.

Figure 2A:
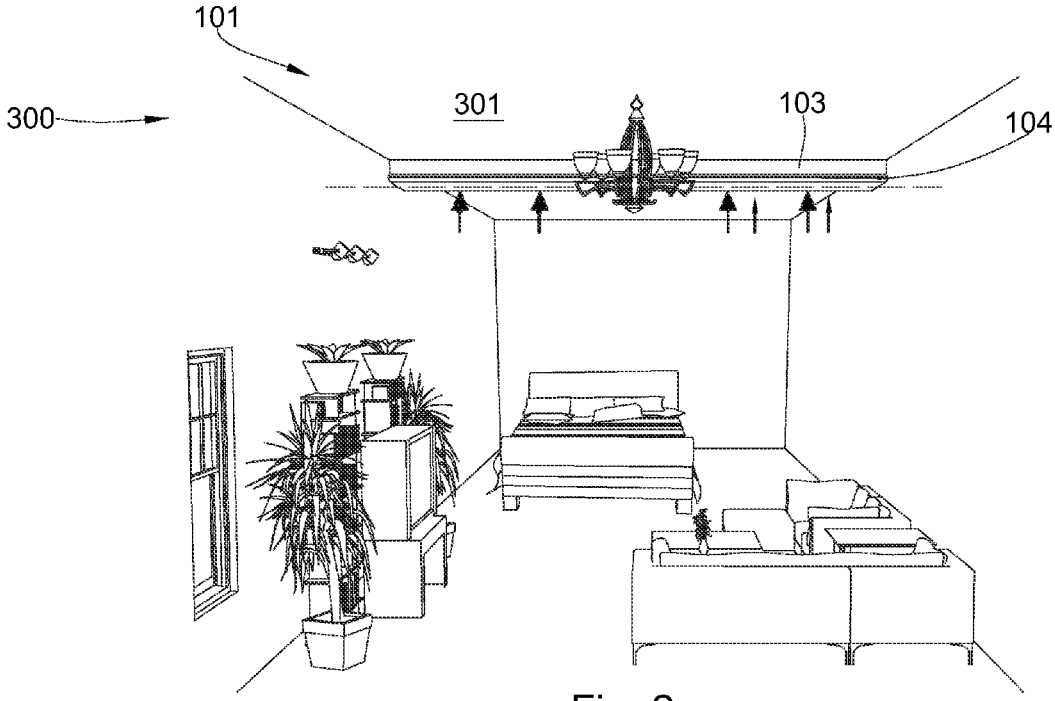
FIG. 2*a* is a perspective view of another embodiment of a structure.
Figure 2B:
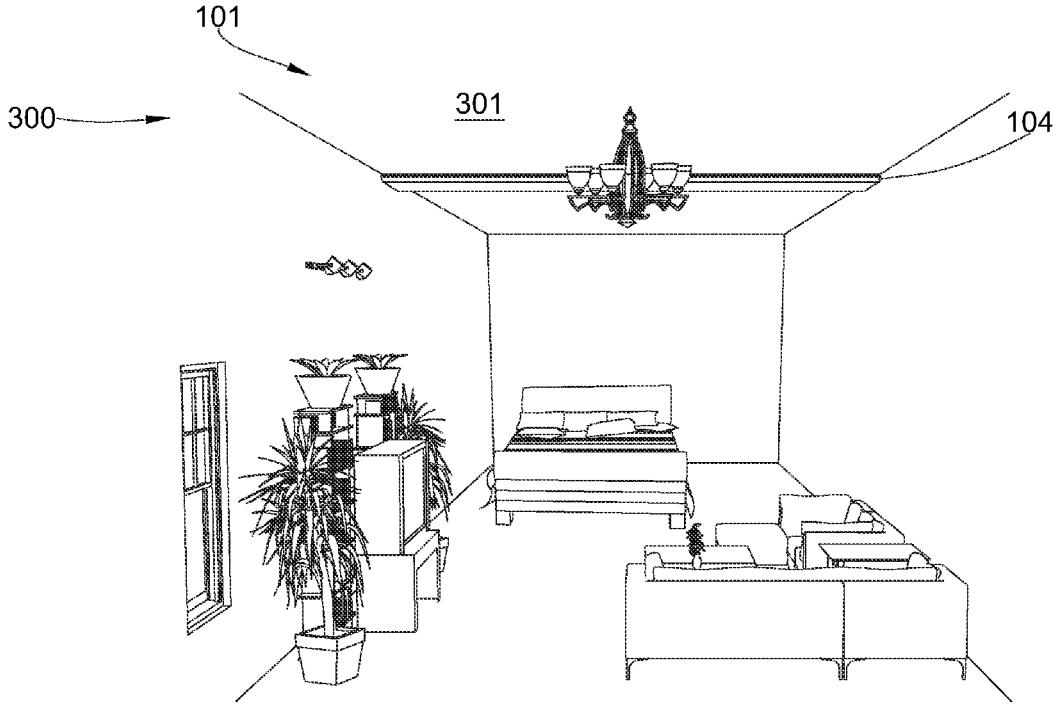
FIG. 2*b* is a perspective view of another embodiment of a structure.

FIGS. 2*a-b* discloses another perspective in which a portion of the living space 101, previously shielded by the wall assembly 100, may be substantially exposed. The wall assembly 100 may rise substantially out of view from within the living space 101 by entering an opening within the overhead structure 300. However, the bottom flange 104 of the first panel 103 may remain outside the second panel 103 while the remaining portions are inside. The second panel 103 may become supported in part by the bottom flange 104 of the first panel 102. FIG. 2*b* discloses the underside of the bottom flange 104 of the first panel 102. The flange 104 may engage the lower surface 301 of the overhead structure 300 to substantially seal the opening through which the first and second panels 102, 103 may pass.

Figure 3A:
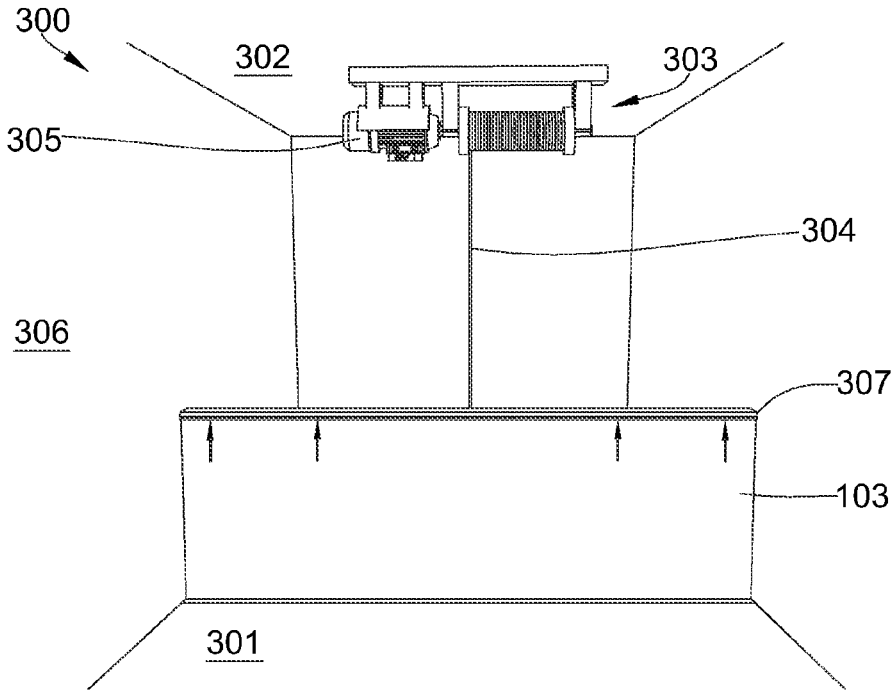
FIG. 3*a* is a perspective view of another embodiment of a structure.

FIG. 3*a* offers a perspective from within the storage space 306 of the overhead structure 300. It discloses how the wall assembly 100 may be pulled into the space 306 by a motorized spool system 303. The second panel 103 may rise upward as it becomes supported by the configuration of the first panel 102, to which the cable 304 is attached. Thus, the wall assembly 100 may pass through an opening in the lower surface 301 of the overhead structure 300. The raising and lowering of the wall assembly 100 may be controlled by the motorized cable 304 and spool system 303. The cable 304 may wind the spool system 303 to raise and lower the wall assembly 100 according to the system's direction of rotation. The rotational power of the spool system 303 may be controlled by a motor 305, which may be substantially attached to the spool system 303. Both the spool system 303 and motor 305 may be attached to the upper surface 302 of the overhead structure 300.

Figure 3B:
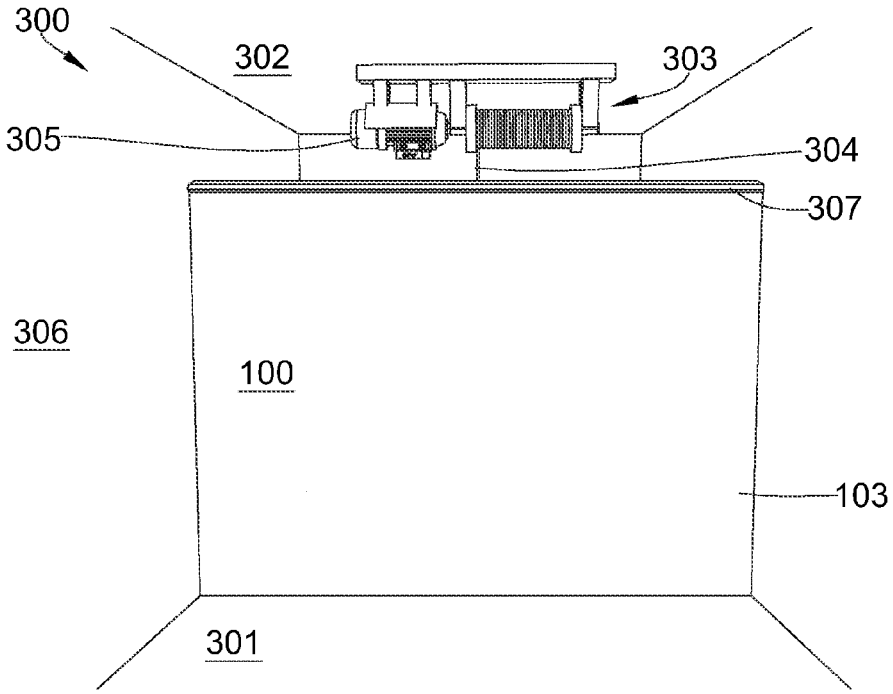
FIG. 3*b* is a perspective view of another embodiment of a structure.

FIG. 3*b* offers an additional perspective of a fully retracted wall assembly 100 located within the storage space 306 of the overhead structure 300. While in a fully retracted position, both the first and second panel 102, 103 may substantially reside within the storage space 306 of the overhead structure 300. Thus, the physical height of the storage space 306 may be larger than a combined height of both the wall assembly 100, in its fully retracted position, and the spool system 303. While in the storage space 306, the wall assembly 100 may be supported by tension from the cable 304, applied by the spool system 303. The spool system 303 may be configured to rotate only as permitted by the motor 305. The cable 304 may run from the spool system 303, through the top of the second panel 103, and attach near the top of the first panel 102.

In some embodiments, a locking mechanism may support the panels while in the overhead structure. In some embodiments, the tension on the cable and the locking mechanism support the panels together.

Figure 4A:
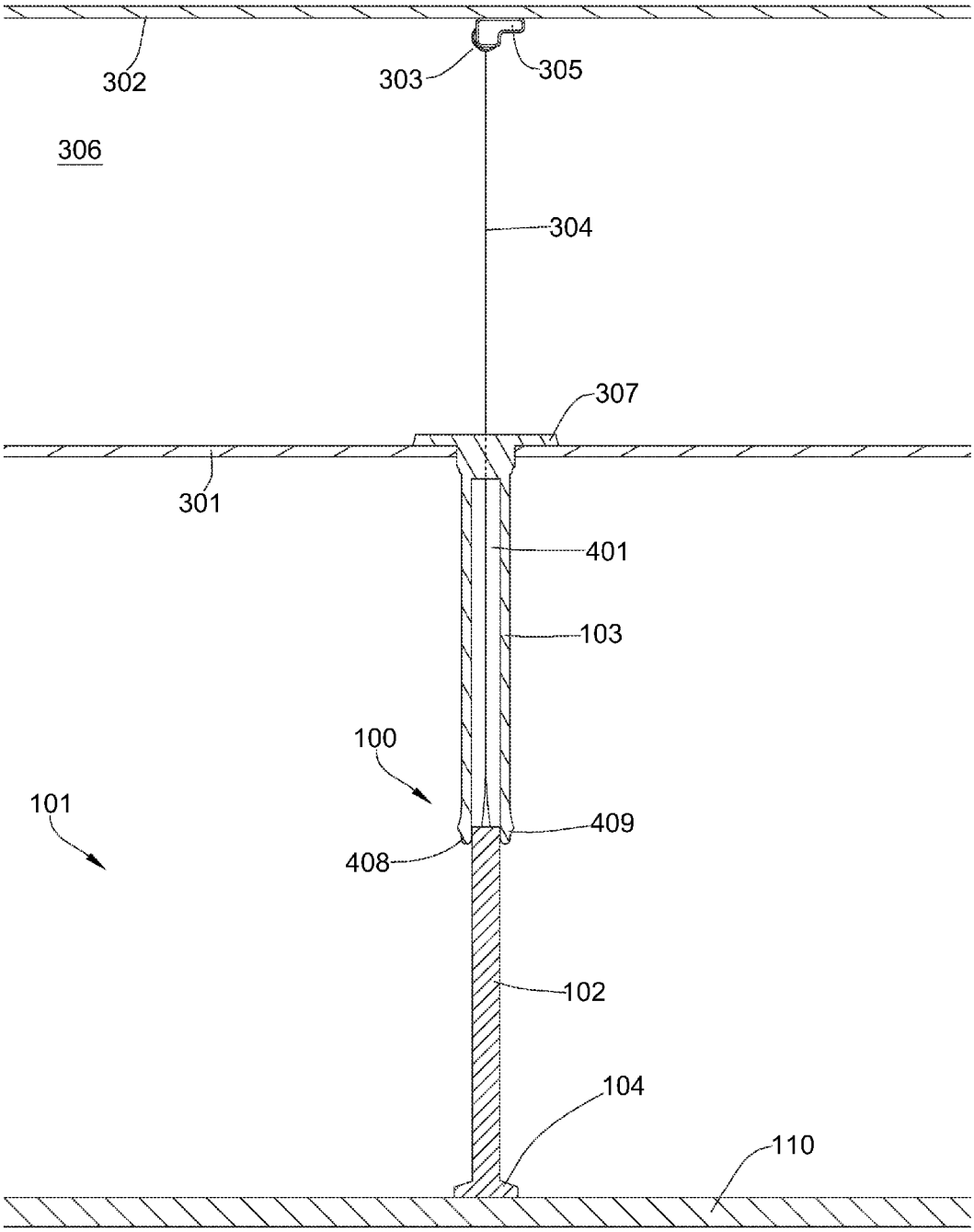
FIG. 4*a* is a cross-sectional view of another embodiment of a wall assembly.

FIG. 4*a* discloses a cross-sectional view of the wall assembly 100 in its fully extended position. In this position the first panel 102 may be supported by its bottom flange 104, which may lie flat on the floor surface 110 of the living space 101. The first panel 102 may also be partially supported by tension from the attached cable 304. The cable 304 may attach to the top portion of the first panel 102. While the wall assembly 100 remains in a fully extended position, a small portion of the first panel 102 may reside within the internal cavity 401 of the second panel 103. The overlap may also provide additional support to the wall assembly 100.

The second panel 103 may also comprise an internal cavity 401, in which the first panel 102 may enter and reside. The internal cavity 401 of the second panel 103 may comprise a height slightly larger than a height of the first and second panel 102, 103. Thus, the first panel 102 may slide into the internal cavity 401 of the second panel 103 to reduce the physical height of the wall assembly 100 as much as possible. Moreover, the height of the storage space 306 may be larger than the physical height of the fully retracted wall assembly 100. This enables the wall assembly 100 to reside easily within the storage space 306 while still leaving room for the motorized spool system 303.

Figure 4B:
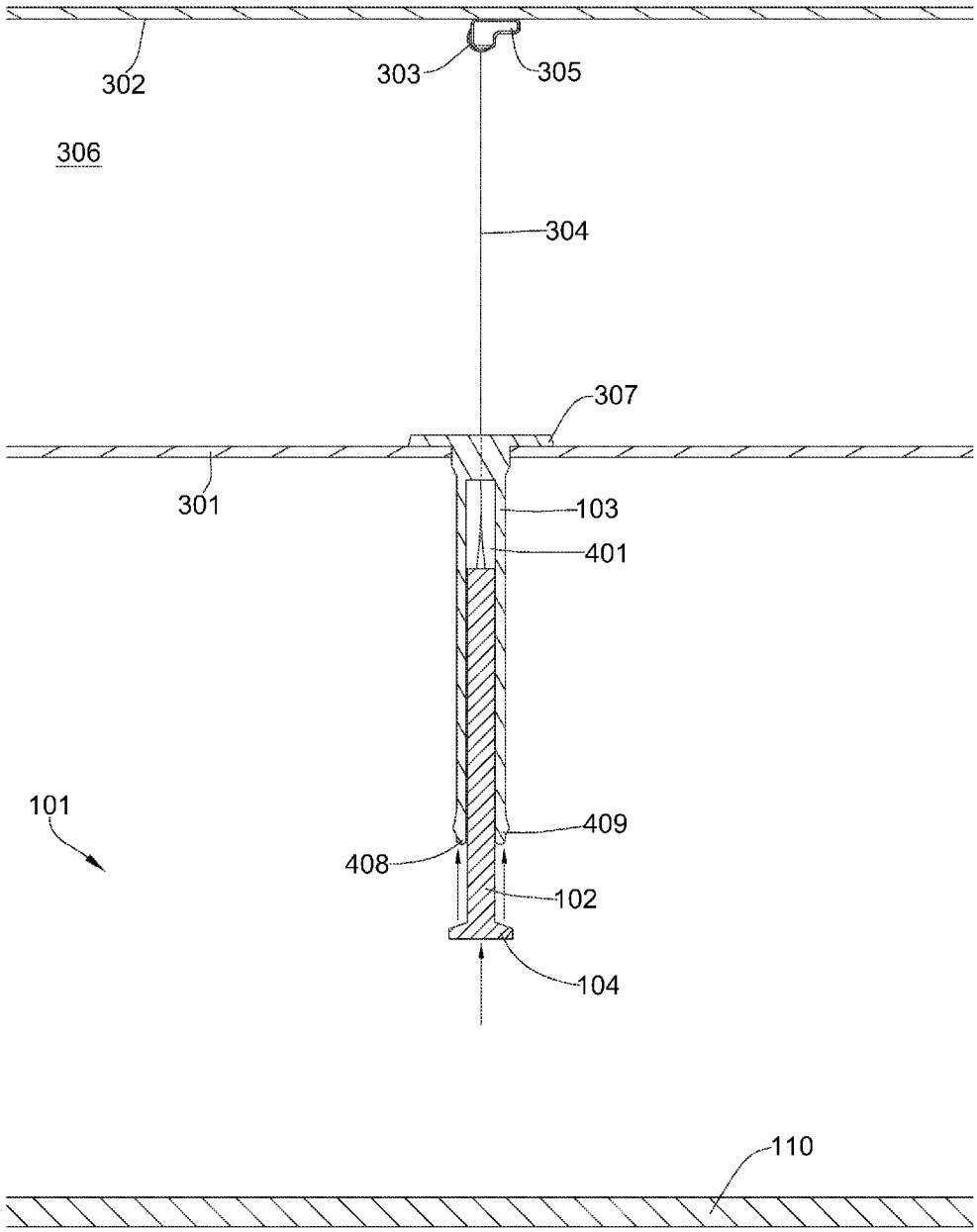
FIG. 4*b* is a cross-sectional view of another embodiment of a wall assembly.

FIG. 4*b* discloses an additional cross-sectional view of the wall assembly 100 in a partially retracted position. The wall assembly 100 may begin to retract as the first panel 102 is pulled upward by a cable 304 and spool system 305. The spool system 303 may be rotated by a motor 305 which enables the cable to wind around the rotating spool system 303. The first panel 102 may rise upward as it is pulled into the internal cavity 401 of the second panel 103. As the first panel 102 continues to be pulled upward, its bottom flange 104 may engage the bottom ends 408, 409 of the second panel 103. As a result, the second panel 103 may also rise upward as it becomes supported by the bottom flange 104 of the first panel 102. Thus, the upward pressure from the bottom flange 104 of the first panel 102 causes both panels 102, 103 to be pulled into the storage space 306 of the overhead structure 300.

Conversely, as the motor 305 of the spool system 303 rotates in an opposite direction, the cable 304 may begin to unwind, allowing the first panel 102 to descend towards the floor surface 110 of the living space. Being supported by the first panel 102, the second panel 103 may also continue towards the floor surface 110. Thus, both the first and second panel 102, 103 fall together until the overhang 307 at the top of the second panel 103 comes into contact with the lower surface 301 of the overhead structure 300.

The second panel 103 may be supported by the lower surface 301 of the overhead structure 300. During the downward dissent of the wall assembly 100, the overhang 307 at the top of the second panel 103, engages the lower surface 301. While the overhang 307 may be supported by the lower surface 301, the longitudinal portions of both the first and second panel 102, 103 may extend downward, passing through an opening within the lower surface 301 and into the living space 101.

As the first panel 102 continues downward, extending beyond second panel 103, the second panel 103 remains supported by the lower surface 301 of the overhead structure 300. The first panel 102, however, may continue to descend until its bottom flange 104 comes into contact with the floor surface 110, upon which it may be supported. The bottom flange 104 of the first panel 102 may also enable the attachment of the first panel 102 to the floor surface 110. The attachment between these two structures may be made by using magnets or an electric drop seal similar to that which is described by Owens in U.S. Pat. No. 5,339,881, which is herein incorporated by reference for all that it contains. The magnetic pull or electronic seal may also add additional support and sealing capacity to the wall assembly 100.

Figure 4C:
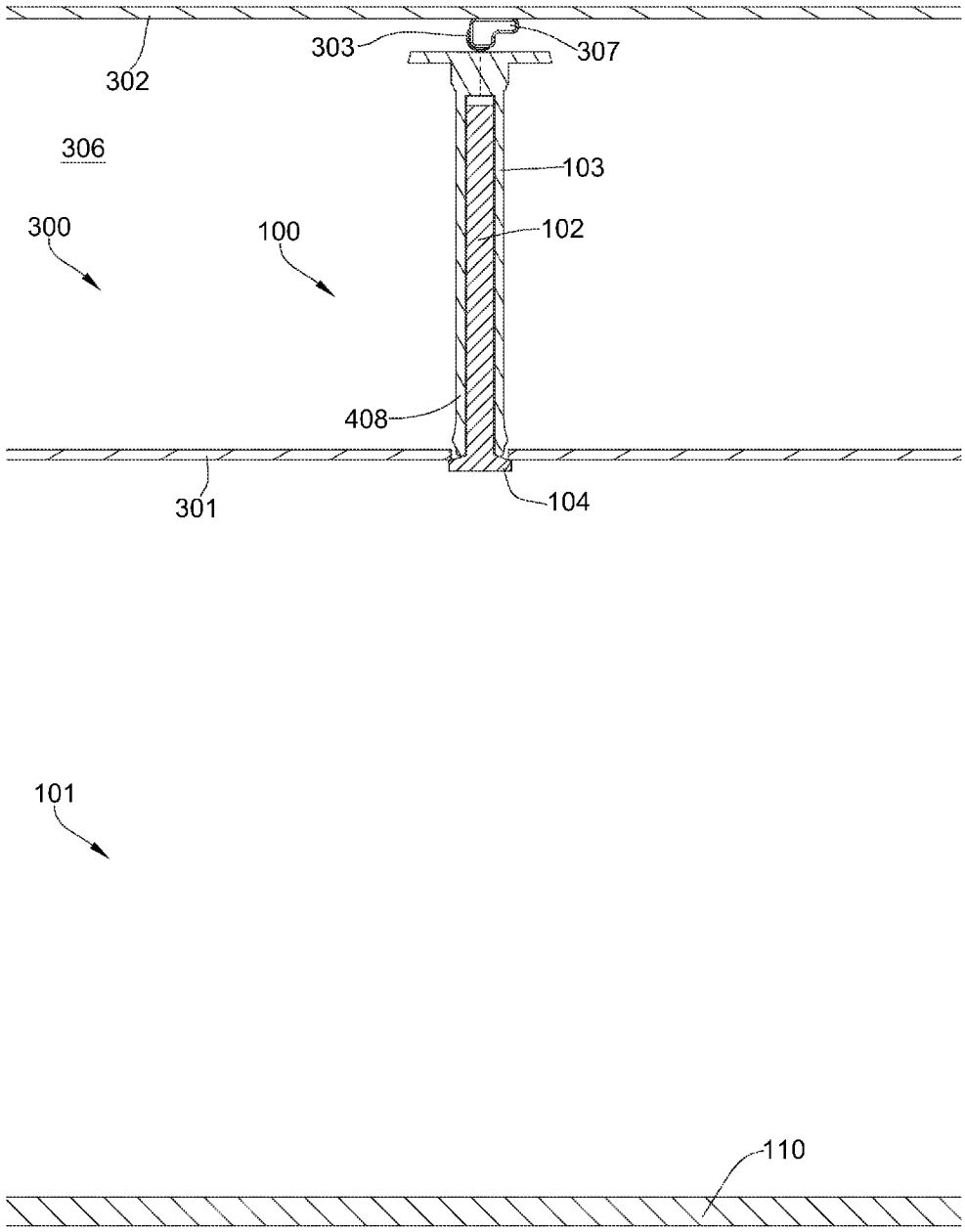
FIG. 4*c* is a cross-sectional view of another embodiment of a wall assembly.

FIG. 4*c* discloses the wall assembly 100 in a fully refracted position, residing substantially within the storage space 306 of the overhead structure 300. The first panel 102 may remain supported by tension from the cable 304 and spool system 303. The bottom flange 104 of the first panel 102 may be engaged with the lower surface 301 of the overhead structure 300 such that it may substantially seal the opening through which the wall assembly 100 may pass. While the bottom flange 104 of the first panel 102 engages the lower surface 301, the longitudinal portion of the first panel 102 may reside substantially within the internal cavity 401 of the second panel 103. Thus, both the first and second panel 102, 103 may reside substantially within the storage space 306 of the overhead structure 300.

Figure 5A:
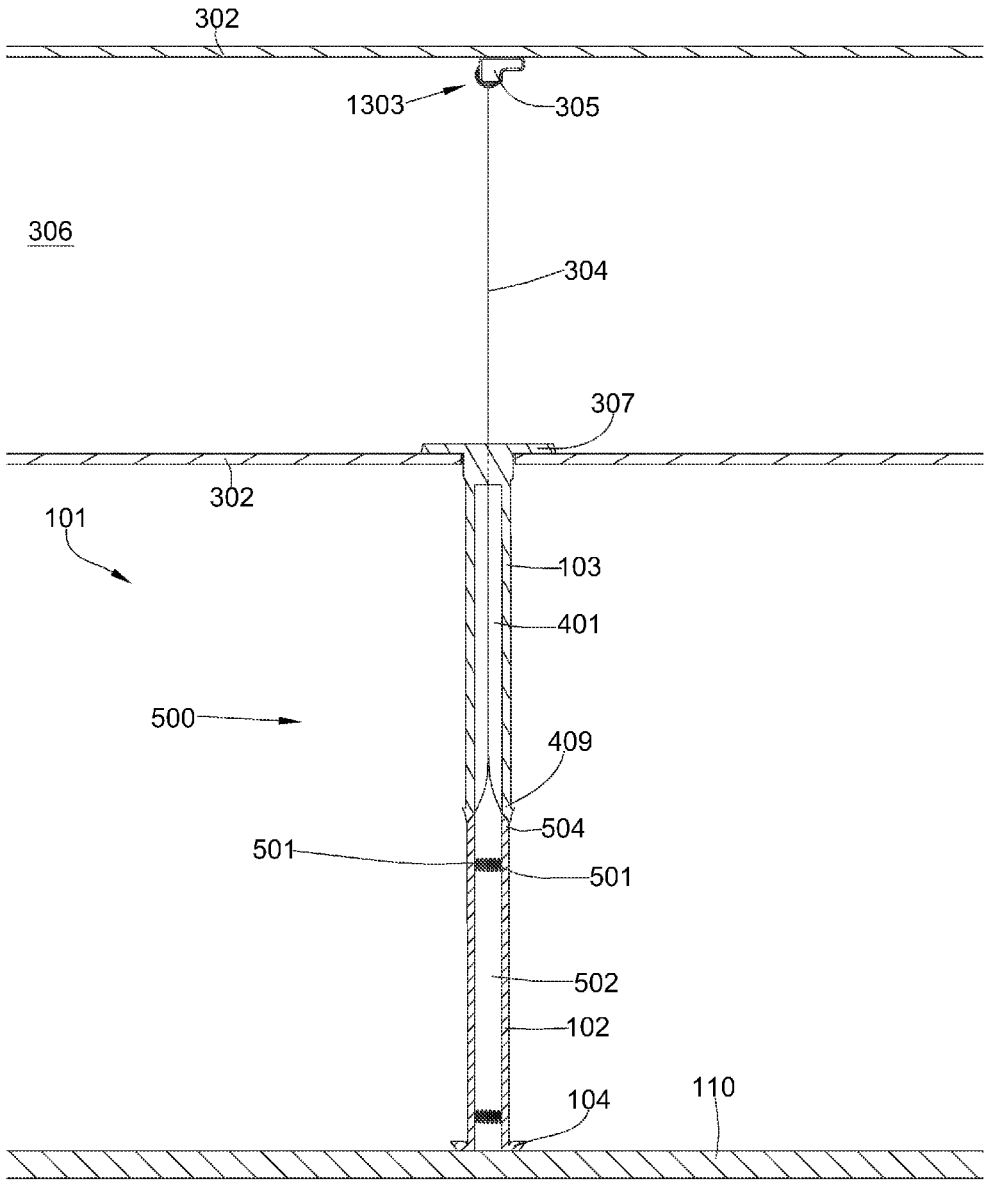
FIG. 5*a* is a cross-sectional view of another embodiment of a wall assembly.
Figure 5B:
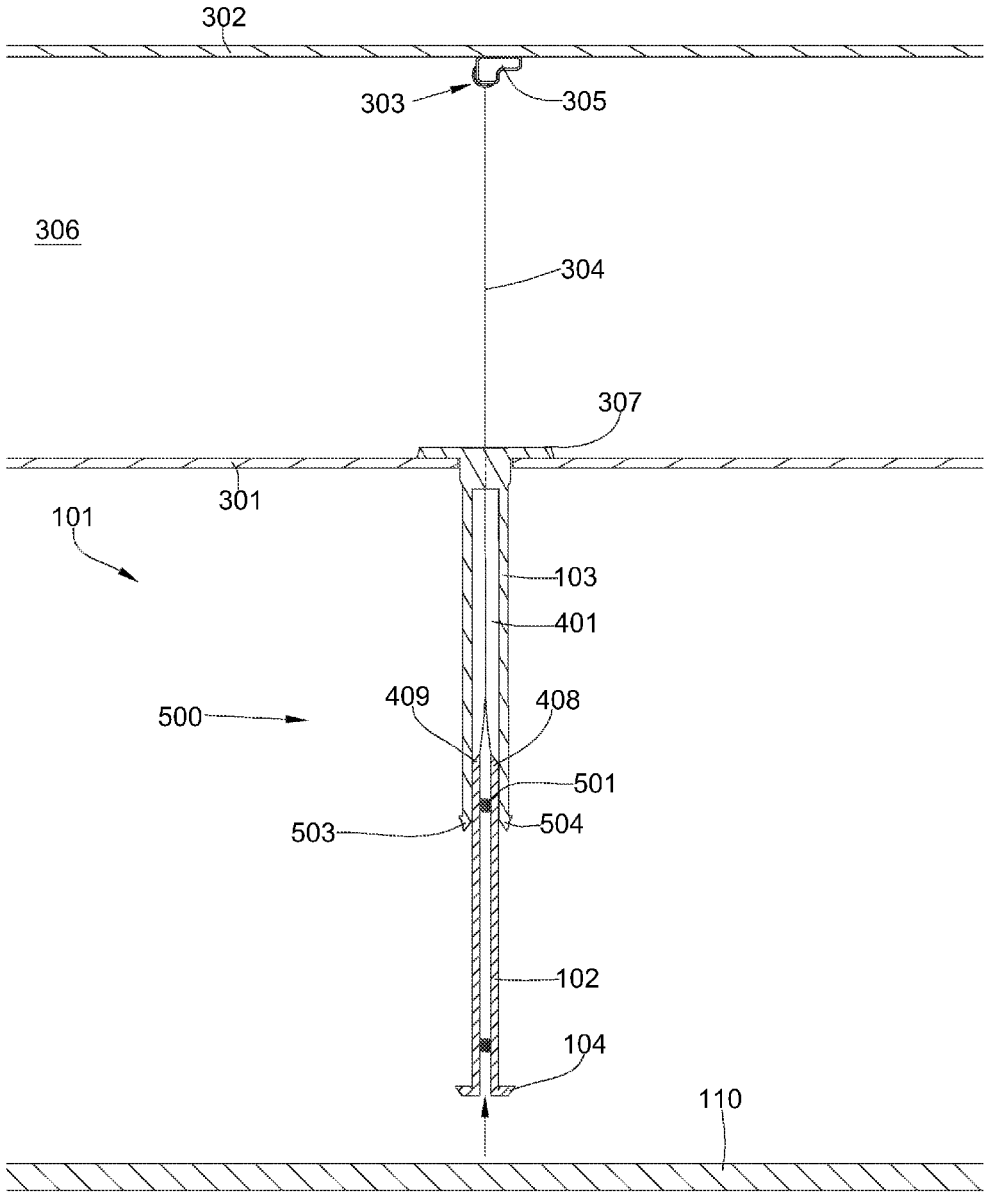
FIG. 5*b* is a cross-sectional view of another embodiment of a wall assembly.

FIG. 5*a-b* discloses a cross-sectional view of an alternative embodiment which discloses a mechanism for compressing the thickness of the first panel 102. While the wall assembly 500 is in its fully extended position, the thickness of the first panel 102 may be substantially equivalent to that of the second panel 103. In its extended position, the first panel 102 remains outside the internal cavity 401 of the second panel 103. However, as the cable 304 pulls the first panel 102 into the internal cavity 401 of the second panel 103, the first panel 102 may be compressed such that its thickness is reduced and its internal cavity 401 is narrowed.

The internal cavity 401 of the first panel 102 may comprise a biasing mechanism 501 such as a spring and/or elastic material. The biasing mechanism 501 may span the internal width of the internal cavity 502, connecting both sides within the panel 102. As the cable 304 begins to pull the first panel 102, its upward ends 503, 504 engage the downward ends 408, 409 of the second panel 103. Moreover, all four engaging ends 503, 504, 408, 409 may comprise angles that facilitate the compression and upward movement of the first panel 102. The angles may comprise a slope of 45 degrees or any other angle that may facilitate the entrance of the first panel 102 within the internal cavity 401 of the second panel 103.

While the elastic device is shown inside the internal cavity 401 of the first panel, the biasing mechanism may be located about the first or second panel in any configuration capable of changing the thickness of the first panel.

Figure 6A:
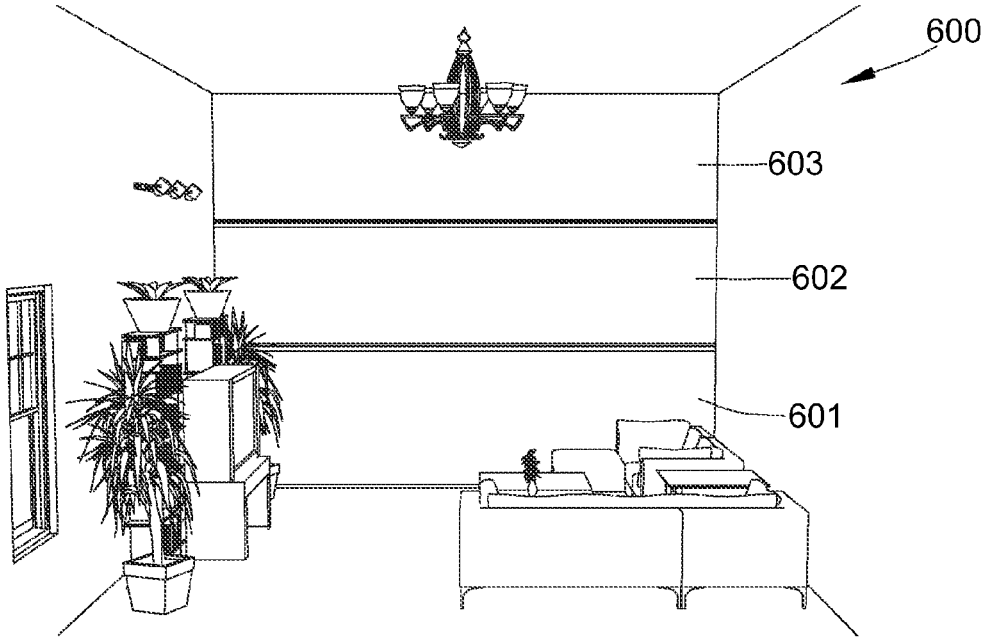
FIG. 6*a* is a perspective view of another embodiment of a structure.
Figure 6B:
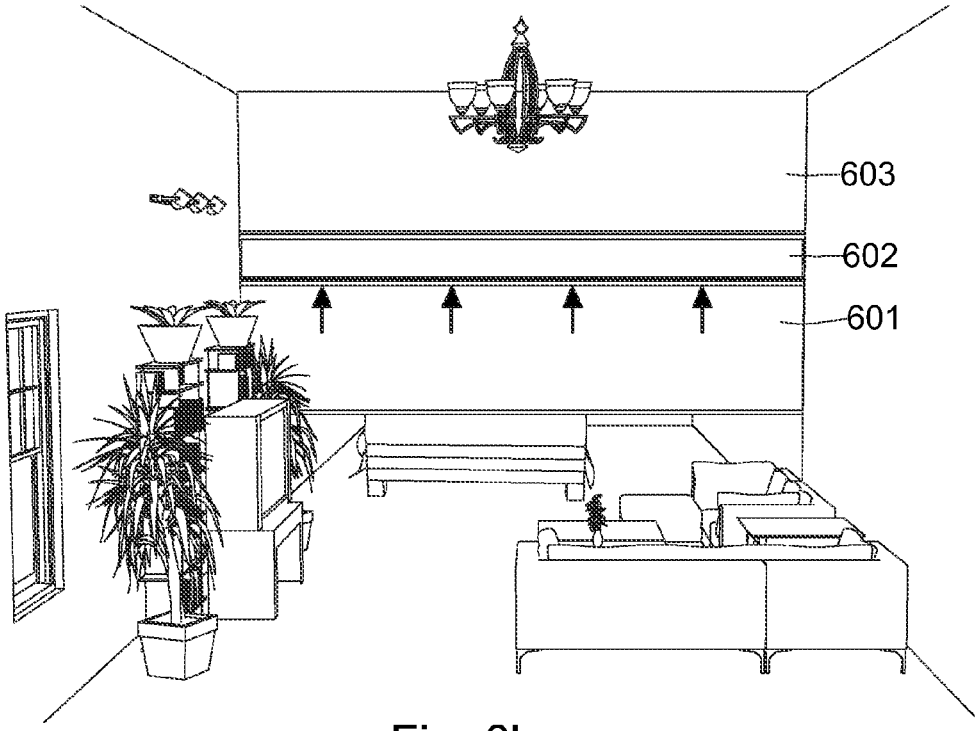
FIG. 6*b* is a perspective view of another embodiment of a structure.

FIGS. 6*a* and 6*b* discloses an alternative embodiment of a wall assembly 600 in an extended and retracted position respectively. This embodiment may comprise three panels such as a first, second, and third panel 603, 602, 601. The first and third panel 603, 601 may comprise internal cavities 703, 702 respectively. The second panel 602 may fit substantially within the internal cavities 703, 702 of the first and second panel 603, 601 to reduce the height of the wall assembly 600. In an extended position, the wall assembly 600 may extend from the floor surface 110 to the overhead structure 300 to substantially divide the area within a living space 101. FIG. 6*b* discloses the third panel 601 rising upward as it slides over the surface of the second panel 602.

Figure 7:
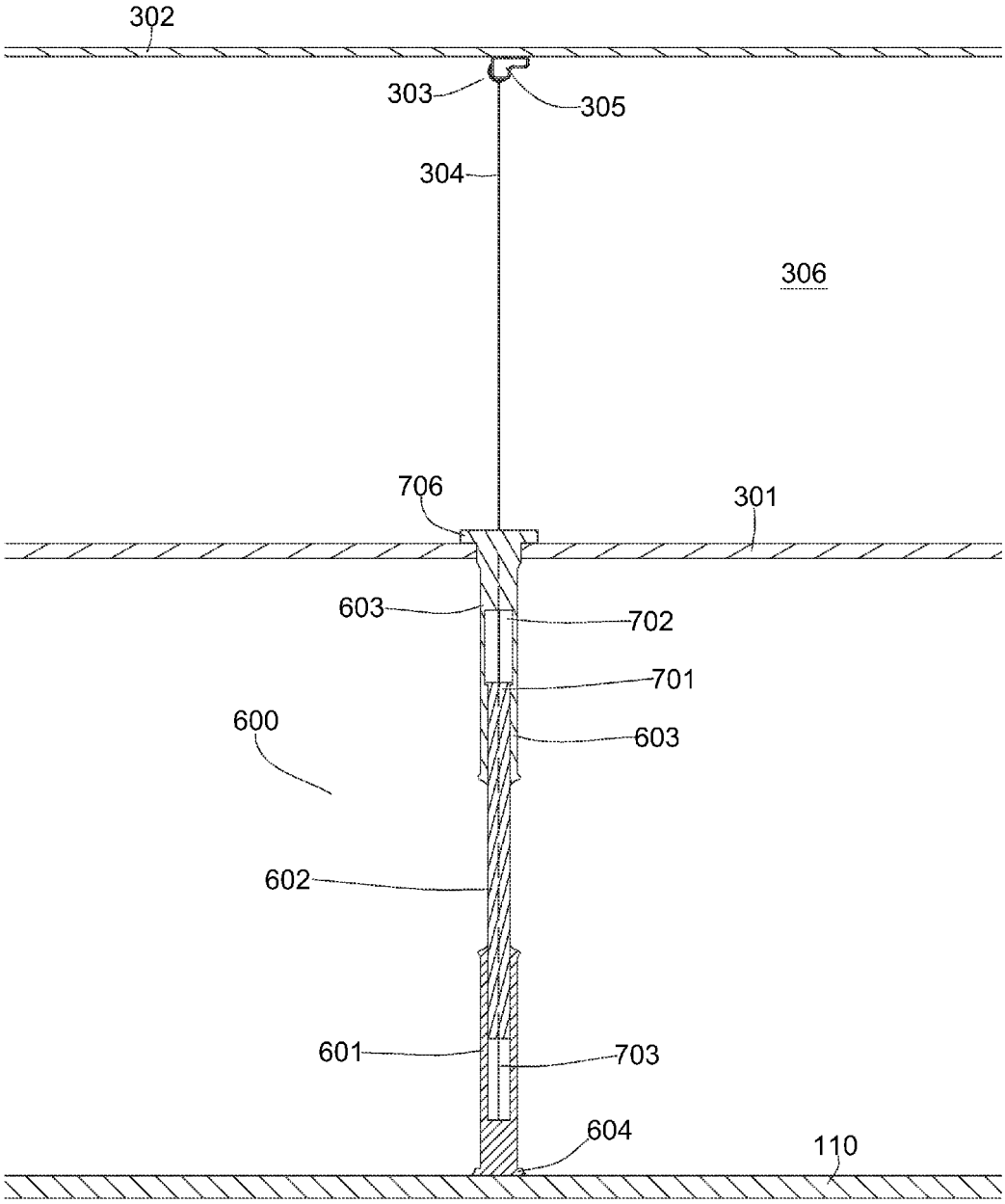
FIG. 7 is a cross-sectional view of another embodiment of a wall assembly.

FIG. 7 discloses a cross-sectional view of another embodiment of a wall assembly 600. In this view, a cable 304 may pass through both the first and second panels 603, 602 and attach to the third panel 601. The second panel 602 may be supported by a shelf 701 within the internal cavity of the first panel 603. The first panel 603 may also be supported by its overhang 706 resting on the lower surface 301 of the overhead structure 300. As the cable 304 shortens by winding around the spool system 303, it may retract the third panel 601, which slides over the second panel 602. As the third panel 601 retracts, its internal cavity 703 may accommodate the second panel 602. This will continue until the bottom of the second panel 602 engages the bottom of the internal cavity 703 of the third panel 601. This may cause the second panel 602 to rise upward in response to pressure from the third panel 601. As the second panel 602 rises it may engage the top of the internal cavity 702 of the first panel 603, which may also rise upward. The wall assembly 600 may continue upward through an opening in the lower surface 301 of the overhead structure 300 until the wall assembly 600 resides substantially within the storage space 306 of the overhead structure 300. Moreover, the bottom flange 604 of the third panel 601 may substantially seal the opening through which the wall assembly 600 may pass.

Figure 8:
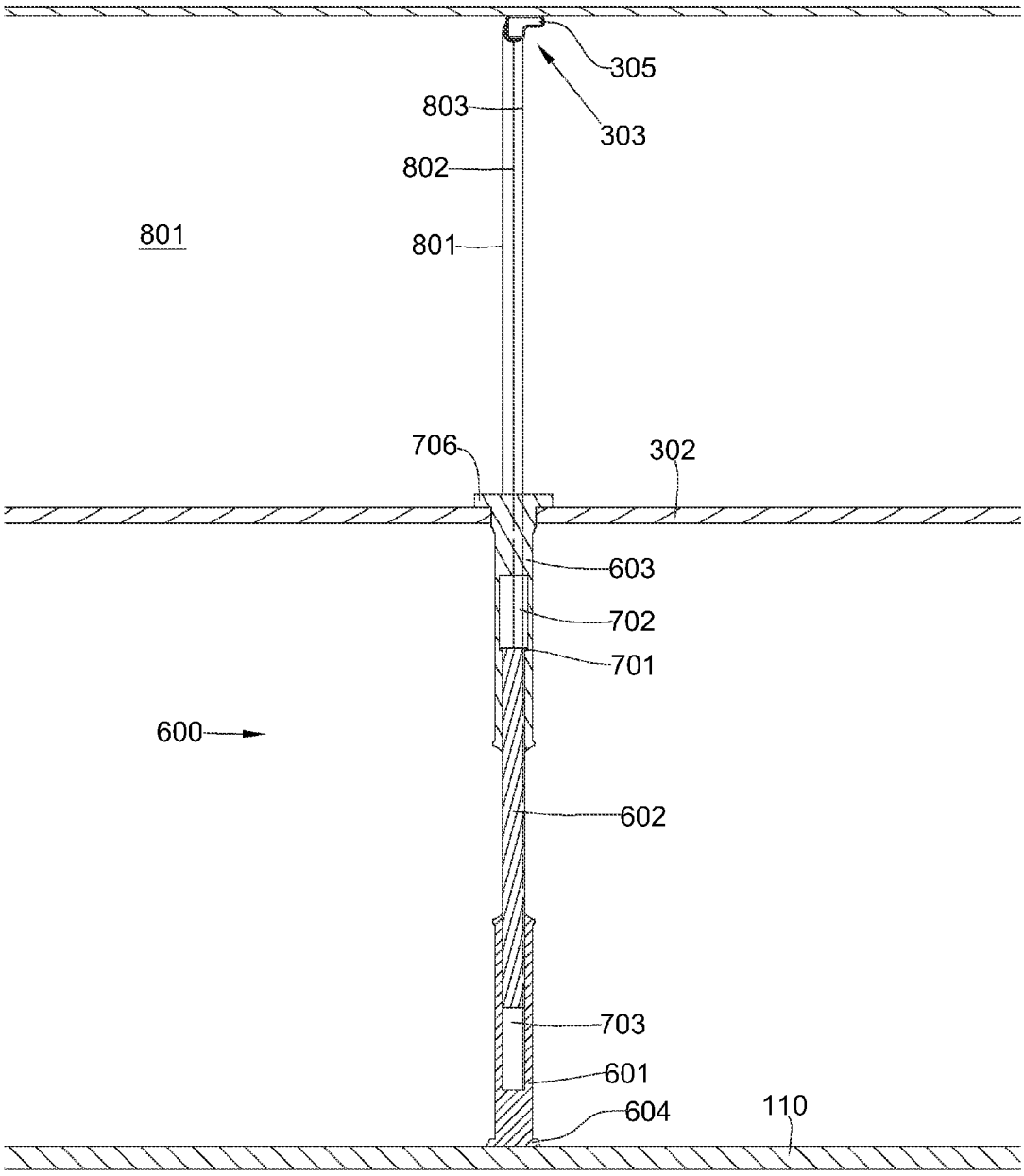
FIG. 8 is a cross-sectional view of another embodiment of a wall assembly.

FIG. 8 discloses a cross-sectional view of another embodiment of a wall assembly 600 comprising three cables such as a first, second, and third cable 801, 802, and 803. The three cables may attach to their respective panels 603, 602, and 601, and may wind at different locations on the spool system 303. As a result, each cable may lengthen or shorten at a different rate.

This arrangement may allow the third panel 601 to retract faster than the second panel 602, which may retract faster than the first panel 603. Thus, the various cables may lengthen or shorten at different rates such that the first, second, and third panel 603,602 and 603 may arrive within the storage space 306 of the overhead structure 300 at substantially the same time. Likewise, this arrangement may allow each panel to be lowered to a rate and length appropriate for forming a wall assembly 600.

While the embodiments of FIGS. 7 and 8 disclose a solid center panel and top and bottom panels with internal cavities, it is contemplated that the plurality of panels could be arranged in any manner. Also, the present invention is not limited to two or three panels. Any number of panels necessary to form a wall tall enough separate the living space into separate rooms, while still being capable of fitting within the storage space is envisioned.

Figure 9:
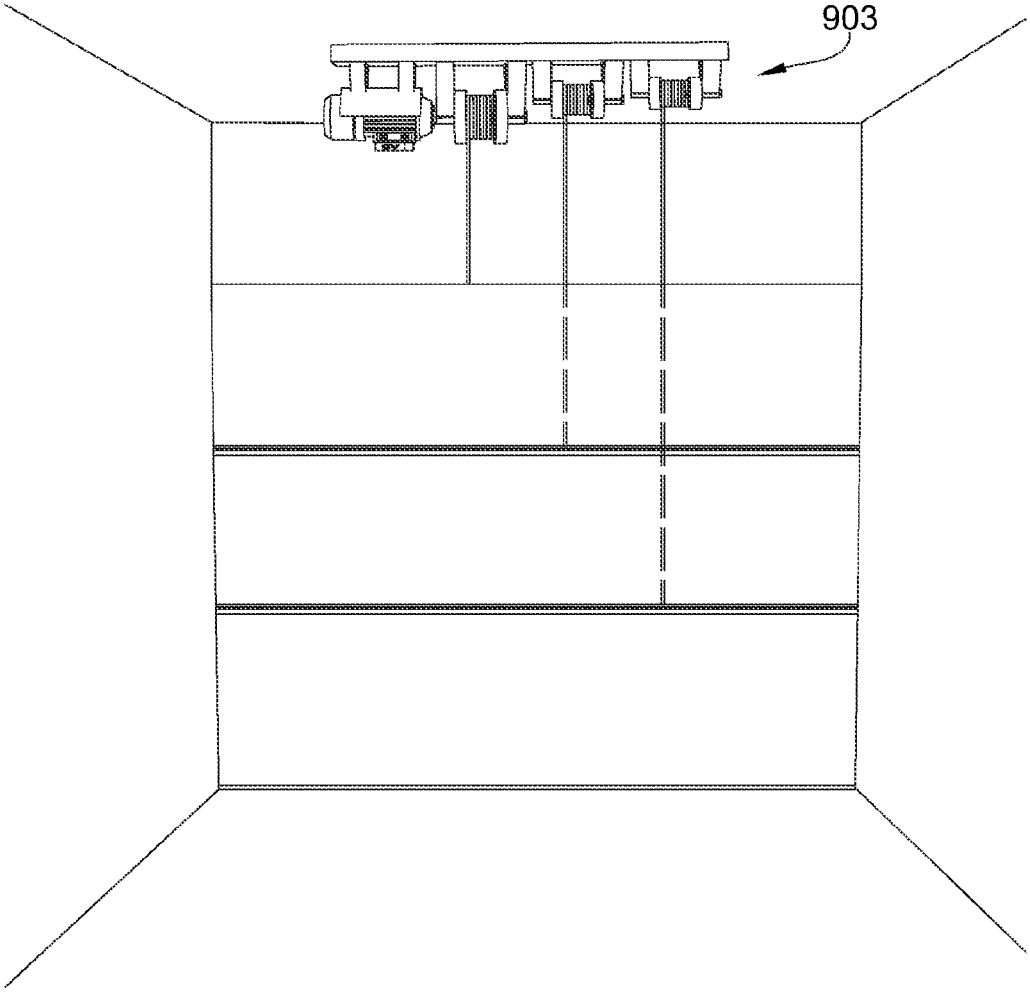
FIG. 9 is a perspective view of an embodiment of a spool system.

FIG. 9 discloses a perspective of an embodiment of a multi-diameter spool system 903. The spool system 903 may comprise three distinct and variable sections. The diameter of each section may be in proportion to the length of the cable to which it is attached. This allows the entire spool system 903 to rotate at a constant rate while each panel rises at a different rate. Each panel may retract at a rate necessary to arrive within the storage space 306 at substantially the same time. Additional embodiments may also comprise various combinations of cables and shelves to achieve a retraction of the wall assembly 600.

Figure 10:
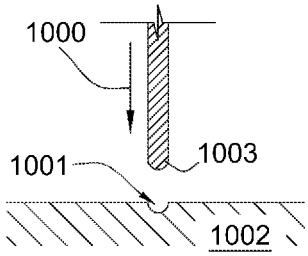
FIG. 10 is a cross-sectional view of another embodiment of a wall assembly.

FIG. 10 discloses an embodiment where a recess 1001 is formed in the floor 1002. A bottom end 1003 of a wall panel 1000 may be inserted into the recess as the panel is lowered. The recess's walls may prevent the panel from sliding after the wall is lowered.

Figure 11:
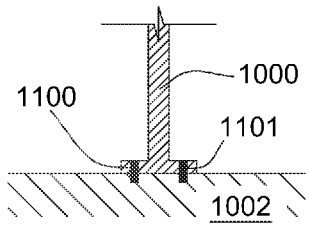
FIG. 11 is a cross-sectional view of another embodiment of a wall assembly.

FIG. 11 discloses an embodiment where pins 1101 and inserted into a flange 1100 formed at the bottom end of the wall. The pins also resist side movement of the wall. The pins may automatically actuate into place or may require manual insertion.

Figure 12:
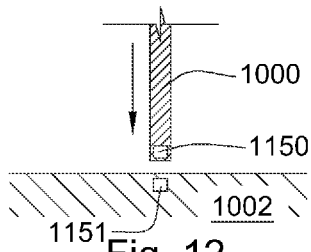
FIG. 12 is a cross-sectional view of another embodiment of a wall assembly.

FIG. 12 discloses an embodiment where a magnet 1151 disposed within the floor interacts with a magnet 1150 disposed within the wall to prevent side movement.

Figure 13:
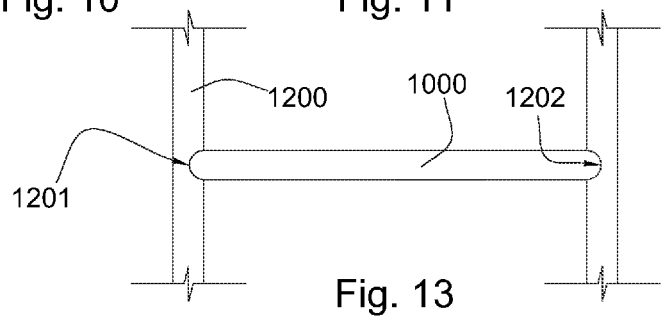
FIG. 13 is a top cross-sectional view of an embodiment of a wall assembly.

FIG. 13 discloses a top view of a temporary wall 1000 and permanent walls 1200. As the temporary wall is raised and lowered the grooves 1201 in the permanent wall may guide the temporary wall's sides 1202.

Figure 14:
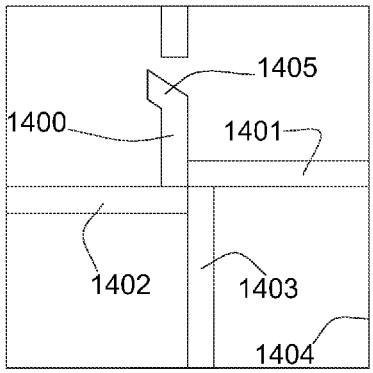
FIG. 14 is a top cross sectional view of an embodiment of a structure layout.

FIG. 14 discloses a layout of floor in the structure. Internal walls 1400, 1401, 1402, and 1403 may be raised and lowered as described above. The walls may incorporate doors 1405, windows, and other openings.

Figure 15:
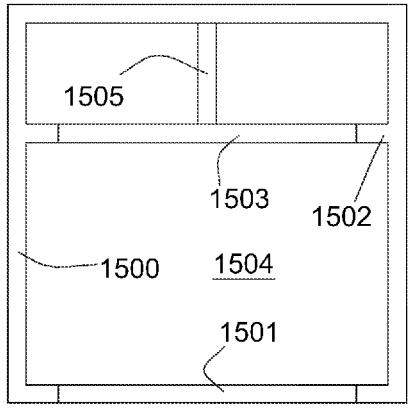
FIG. 15 is a top cross sectional view of another embodiment of a structure layout.

FIG. 15 discloses another floor layout. In this embodiment, temporary wall 1505 is disposed between a permanent wall and temporary portion 1503 of an internal wall. An internal wall may have a permanent portion 1502 and a temporary portion 1503. An exterior wall may also have a temporary portion 1501. Thus, the temporary portion 1501 may form a door for room 1504.

Whereas the present invention has been described in particular relation to the drawings attached hereto, it should be understood that other and further modifications apart from those shown or suggested herein, may be made within the scope and spirit of the present invention.

What is claimed is:

1. A wall assembly, comprising:

a first panel and a second panel;

the first panel is configured to reside within an internal cavity of the second panel;

the first panel is configured to extend beyond the second panel such that the first panel and second panel collectively form at least part of a wall;

a cable connecting the first panel to an overhead structure;

the overhead structure comprising a storage space; and the cable is configured to pull the first panel into the storage space of the overhead structure;

wherein the storage space of the overhead structure comprises a storage height greater than a collective height of the panels when the first panel resides substantially within the second panel.

2. The assembly of claim 1, wherein the internal cavity of the second panel comprises dimensions capable of enclosing the first panel.

3. The assembly of claim 1, wherein the second panel further comprises an overhang formed proximate a top end of the second panel, wherein the overhang is configured to hang off a lower surface of the storage space.

4. The assembly of claim 1, wherein the first panel comprises a flange configured to engage the second panel when the first panel is raised.

5. An assembly incorporating claim 4, wherein the flange also is configured to substantially seal off an opening that the panels pass through in the overhead structure, when the panels are fully retracted.

6. The assembly of claim 1, wherein the bottom of the first panel comprises magnets that may laterally lock the first panel to a floor.

7. The assembly of claim 1, wherein the panels slide against adjoining walls along adjoining edges, wherein the adjoining edges comprise a planar bearing surface to facilitate the movement of the wall assembly along any adjoining surface.

8. The assembly of claim 7, wherein the adjoining edges are biased towards the adjoining walls.

9. The assembly of claim 1, wherein the cable is at least partially wound about a spool attached to an upper surface of the overhead structure.

10. The assembly of claim 9, wherein the cable connects the spool to the first panel through the internal cavity of second panel.

11. The assembly of claim 9, wherein the spool is driven by a motor.

12. The assembly of claim 1, wherein the first panel comprises another internal cavity that comprises an expandable element configured to adjust the thickness of the first panel.

13. The assembly of claim 12, wherein the first panel is configured to reduce its thickness by compressing the expandable element as the first panel is pulled into the other internal cavity of the second panel.

14. The assembly of claim 1, wherein the assembly comprises a third panel that is substantially co-planar with the first and second panel.

15. The assembly of claim 1, wherein the first and second panels are supported by the cable.

16. The assembly of claim 1, wherein the assembly forms at least part of an internal wall of a structure.

17. The assembly of claim 1, wherein a locking mechanism supports the panels while retracted into the storage space.

18. The assembly of claim 1, wherein the assembly is incorporated into an exterior wall of a structural.

19. The assembly of claim 1, wherein the panels are made of materials that are collectively light enough for a person to lift manually.

* * * * *